United States Patent [19]

Kodama et al.

[11] Patent Number: 4,538,650

[45] Date of Patent: Sep. 3, 1985

[54] METHOD FOR PREPARING WEFT SUPPLY TO BE PICKED UPON STARTING THE OPERATION OF A WEAVING LOOM, AND AN APPARATUS FOR EFFECTING THE SAME

[75] Inventors: Ikuo Kodama, Toyota; Masaharu Inoue, Kariya; Masao Shiraki, Toyota; Hajime Suzuki, Anjo, all of Japan

[73] Assignee: Kabushiki Kaisha Toyoda Jidoshokki Seisakusho, Kariya, Japan

[21] Appl. No.: 555,954

[22] Filed: Nov. 29, 1983

[30] Foreign Application Priority Data

Dec. 9, 1982 [JP] Japan ..... 57-185325
Dec. 27, 1982 [JP] Japan ..... 57-227153

[51] Int. Cl.[3] ..... D03D 47/36

[52] U.S. Cl. ..... 139/452; 242/47.01; 242/47.12

[58] Field of Search ..... 139/452, 450, 435, 1 E; 242/47.01, 47.12; 66/132 R

[56] References Cited

U.S. PATENT DOCUMENTS 3,411,548 11/1968 Pfarrwaller ..... 139/452
3,805,850 4/1974 Van Duynhoven et al. ..... 139/1 E
4,079,759 3/1978 Riha et al. ..... 139/452
4,244,399 1/1981 Palan et al. ..... 139/1 E
4,381,807 5/1983 Umezawa et al. ..... 139/452

FOREIGN PATENT DOCUMENTS 2935507 3/1981 Fed. Rep. of Germany ..... 139/1 E
2038892 7/1980 United Kingdom ..... 139/452

*Primary Examiner*—James Kee Chi
*Attorney, Agent, or Firm*—Brooks Haidt Haffner & Delahunty

[57] ABSTRACT

A method for preparing weft supply to be picked upon starting the operation of a weaving loom, the weaving loom comprising a main motor for driving the weaving loom, a crank shaft driven by the main motor, a drum for measuring weft to be picked by a main air jet nozzle, a driving system of the weft measuring drum, and an auxiliary motor for driving the weft measuring drum. The method comprises releasing the normal connection between the driving system of the weft measuring drum and the main motor for driving the weaving loom so as to enable an auxiliary motor to drive the driving system of the weft measuring drum. The weft measuring drum is then positioned by the auxiliary motor at a position suitable for being threaded with the weft. The weft is then threaded onto the weft measuring drum, whereupon the weft measuring drum is driven by the auxiliary motor so as to store a predetermined amount of weft thereon.

21 Claims, 8 Drawing Figures

METHOD FOR PREPARING WEFT SUPPLY TO BE PICKED UPON STARTING THE OPERATION OF A WEAVING LOOM, AND AN APPARATUS FOR EFFECTING THE SAME

TECHNICAL FIELD TO WHICH THE INVENTION RELATES

The present invention relates to a method for preparing a weft supply to be picked upon starting the operation of a weaving loom, and an apparatus for effecting the method. The weaving loom, in which the method of the present invention is performed, comprises a means for driving the weaving loom, a means for measuring the weft to be picked by a picking means, a means for driving the weft measuring means, and an auxiliary means for driving the weft measuring means. According to the present invention, the supply of weft yarn can be automatically prepared in a drum pool type jet loom wherein a weft withdrawn from a weft cheese is stored on a weft measuring drum and the stored weft is picked by means of a jet nozzle. The weft measuring drum of the present invention may be either of a type wherein a drum is rotated to wind a weft on the surface thereof or of a type wherein the drum is stationary and a weft winding pipe rotates around the drum to wind a weft on the surface of the drum.

RELEVANT BACKGROUND ART

A drum pool type weft storing device is required to rotate completely in synchronism with the rotation of the crank shaft of a weaving loom, and the drum should not be reversed. If the device does not rotate in synchronism with the crank shaft, a weft with a predetermined length cannot be inserted at a predetermined picking timing. Further, if the drum is rotated in a reverse direction, the weft windings will be disarranged and the weft cannot be readily picked.

A weaving loom occasionally stops its operation due to a yarn breakage or other reasons caused during the weaving operation. In such a case, operation of the machine is restarted after the causes for stoppage are removed or repaired. Even in this case, because of the reasons described above, the drum pool type weft storing device must rotate completely in synchronism with the rotation of the crank shaft of the weaving loom, and the drum should not be reversed.

According to conventional methods, the operation of the machine is restarted after a weft is manually wound onto the surface of the drum upon stoppage of the operation of the weaving loom due to a yarn breakage or other reasons caused during the weaving operation.

Although it seems very easy, it takes skill of the operator to thread a weft onto the drum. Accordingly, it often takes a long time to thread and prepare a weft, and the loom is stopped for a long time. Further, the loom cannot be smoothly restarted because the length of the wound weft is often inadequate.

DISCLOSURE OF THE INVENTION

The present invention provides a method by which a weft is automatically wound onto a drum pool type weft storing device and by which a weft, having a predetermined length required for one picking operation, can be automatically stored.

According to one aspect of the present invention, a method for preparing weft supply to be picked upon start of the operation of a weaving loom is provided, wherein the weaving loom comprises a means for driving the weaving loom, a means for measuring the weft to be picked by a picking means, a means for driving the weft measuring means, and an auxiliary means for driving the weft measuring means. The method comprises:

releasing the connection between the means for driving the weft measuring means and the weaving loom driving means so as to enable the auxiliary means to drive the means for driving the weft measuring means;

positioning the weft measuring means by means of the auxiliary means at a position suitable for being threaded with the weft;

threading the weft onto the weft measuring means; and driving the weft measuring means by the auxiliary means so as to store a predetermined amount of weft thereon.

The present invention also provides an apparatus for effectively performing the method.

According to this aspect of the present invention, an apparatus for preparing the weft supply to be picked upon start of the operation of a weaving loom is provided, wherein the weaving loom comprises a means for driving the weaving loom, a means for measuring the weft to be picked by the picking means, a means for driving the weft measuring means, and an auxiliary means for driving the weft measuring means. The apparatus further comprises:

a means for switching the connection of the means for driving the weft measuring means between the weaving loom driving means and the auxiliary means for driving the weft measuring means; and a means for positioning the weft measuring means at a position suitable for being threaded with the weft when the weft measuring means is driven by the auxiliary means and for controlling the auxiliary means so as to store a predetermined amount of weft on the weft measuring means after threading thereonto.

ADVANTAGES OF THE INVENTION

According to the present invention, winding of a weft about a weft measuring drum can be done almost automatically, and the labor consumption of an operator can be minimized, and the productivity of the human labor is enhanced. In addition, faulty operations due to unskilled labor can be prevented from occurring.

BRIEF DESCRIPTION OF THE DRAWINGS

The present invention will now be explained in detail with reference to the accompanying drawings, wherein.

DESCRIPTION OF WAY OF CARRYING OUT THE INVENTION

Figure 1:
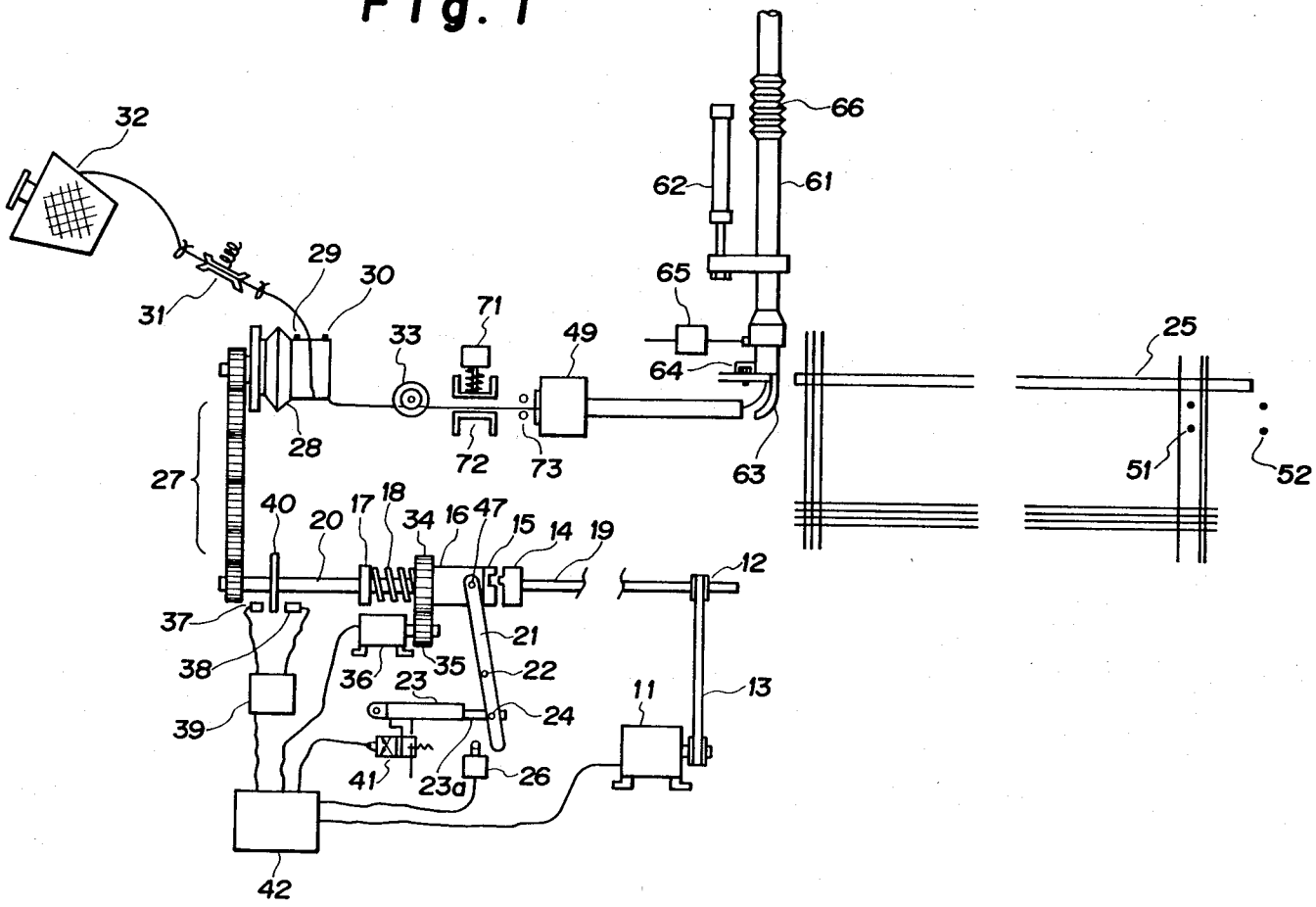
FIG. 1 is a plan view illustrating a driving system of an air jet loom for practicing a method of the present invention.

In FIG. 1, a crank shaft 12 of a weaving loom is driven by a main motor 11 of the weaving loom via a belt 13. The crank shaft 12 is also operatively connected to a weft measuring drum 28 through clutch members 14 and 15 and gear trains 27.

The weft is withdrawn from a weft cheese 32 through a tensioner 31 and is wound onto the weft measuring drum 28, when the weft measuring drum 28 is rotated. The weft measuring drum 28 has pins 29 and 30 which are disposed in such a manner that they project from and retract from the surface of the weft measuring drum 28 in synchronism with the rotation of the crank shaft 12. Accordingly, the pins 29 and 30 control the winding of the weft onto the weft measuring drum 28 and the withdrawal of the weft to a jet nozzle 49.

The clutch member 14 is integrally fixed to the driving shaft 19 which is operatively connected to the crank shaft 12. The clutch member 15 is splined and engages with a splined portion of the driven shaft 20. A sleeve 16 is inserted onto the driven shaft 20 in such a manner that it can rotate about the driven shaft 20 and can move in an axial direction of the latter. Accordingly, the clutch member 15 axially moves with the sleeve 16 and can rotate relative to the sleeve 16.

The clutch members 14 and 15 have an engaging projection and recess, respectively, formed at portions eccentric with respect to the rotary axes of the driving shaft 19 and the driven shaft 20 so that the clutch members 14 and 15 engage with each other only when the angular phases of the engaging projection and recess are aligned with each other.

A gear 34 is disposed at the left side of the sleeve 16 and is integrally secured to the clutch member 15. The gear 34 and the clutch member 15 sandwiches the sleeve 16 therebetween.

The gear 34 has a splined hole which engages with the splined portion of the driven shaft 20. A compression spring 18 is disposed between a boss 17 fixed to the driven shaft 20 and the gear 34. The spring 18 normally urges the gear 34 and the clutch member 15 to the right, i.e., towards the clutch member 14. The gear 34 can engage with a gear 35 attached to a drive shaft of an auxiliary motor 36.

A lever 21 is swingably supported on a pin 22, and one end of the lever 21 is engaging with the sleeve 16 by a pin 47. The other end of the lever 21 is connected to a piston rod **23*a* of a pneumatic cylinder 23 by means of a pin 24. When the piston rod of the pneumatic cylinder 23 is extended by switching a directional control valve 41, the clutch members 14 and 15 are disengaged from each other against the spring force of the compression spring 18, and the gears 34 and 35 engage with each other. As a result, the rotation of the auxiliary motor 36 is transmitted to the weft measuring drum 28 through the gears 34 and 35, the driven shaft 20 and the gear trains 27**.

Contrary to this, when the piston rod **23*a* of the pneumatic cylinder 23 is retracted, the clutch members 14 and 15 engage with each other due to the spring force of the compression spring 18, and the gears 34 and 35 disengage from each other. As a result, the rotation of the main motor 12 is transmitted to the weft measuring drum 28 through the belt 13, the driving shaft 12, the clutch members 14 and 15, the driven shaft 20 and the gear trains 27**.

The driven shaft 20 has a disc 40 attached thereto for detecting the angular phase thereof. The disc 40 has a slit or opening formed therein which can be detected by means of a paired light emitter and receiver 37 and 38. A proximity switch may be used in place of the light emitter and receiver as will be described later. Reference numeral 39 denotes a control box of the light emitter and receiver 37 and 38, 26 denotes a limit switch for detecting the engagement of the clutch members 14 and 15, and 42 is a control box.

A gripper 33 is disposed downstream of the weft measuring drum 28, and it opens and closes in synchronism with the rotation of the crank shaft 12 of the weaving loom. An auxiliary gripper 72 is disposed downstream of the gripper 33 and is operated by an electromagnet 71 independent from the gripper 33. A main air jet nozzle 49 ejects compressed air in synchronism with the rotary movement of the crank shaft 12 so as to pick a weft into an opening formed between warps. A feeler 73 is disposed between the auxiliary gripper 72 and the main air jet nozzle 49 and detects whether or not a weft is supplied with the main air jet nozzle 49. Feelers 51 and 52 are disposed at positions opposite the main air jet nozzle 49 and detect the picking of a weft. Reference numeral 25 is a reed for beating the picked weft.

A suction nozzle 61 is of an ejector type and is disposed at a position between the main air jet nozzle 49 and the selvage. The suction nozzle 61 has a suitable reciprocating member 62, such as a piston rod of a pneumatic cylinder or an armature of an electromagnetic solenoid, connected thereto. The rear end of the suction nozzle 61 is connected to a flexible tube 66. As the reciprocating member 62 operates, a guide plate attached to the front end of the suction nozzle 61 can move between a position apart from the passage of the weft ejected from the main air jet nozzle 49 and a position crossing the weft passage. Reference numeral 64 denotes a cutter for severing a weft which is disposed at a position near the front end of the main air jet nozzle 49, and 65 denotes a valve which controls the ejection of air flow into the suction nozzle 61.

An embodiment of a method for preparing a weft supply according to the present invention after faulty stoppage will now be explained.

During the normal operation, driving the crank shaft 12 by the main motor 11, heald frames are subjected to a shedding operation, and wefts are picked into the open shed formed between the upper and lower warps. More specifically, in FIG. 1, the weft is withdrawn from the cheese 32 through the tensioner 31 and is measured by means of the measuring drum 28 which rotates in synchronism with the rotation of the crankshaft 12. Thereafter, the weft reaches the main air jet nozzle 49 through the gripper 33. The operations of the gripper 33 and the main air jet nozzle 49 are controlled in synchronism with the rotation of the crankshaft 12, so that the weft, which has been stored on the surface of the weft measuring drum 28, is picked into the open shed formed between the upper and lower warps by means of compressed air ejected from the main air jet nozzle 49.

The detectors 51 and 52, which are disposed at positions near the selvage opposite the main air jet nozzle 49, investigate whether or not a weft is picked while the warps are closed (i.e., at a crank angle between 250 and 300 degrees). When a picking fault occurs, wherein a weft which has been picked into the open shed does not reach the selvage located opposite the main air jet nozzle 49 because of any one of a number of reasons, the detector 51 or 52 emits a faulty picking signal. Based on a signal for stopping the main motor, such as the faulty picking signal, (at time $t_1$ in FIG. 2) the motor 11 for driving the weaving loom is switched off and the weaving loom continues its operation due to inertia force.

In addition, when the faulty picking signal is emitted, the piston of the reciprocating member 62 is moved forwardly so that the guide plate 63 attached to the front end of the suction nozzle 61 is located at a position across and blocking the weft passage. As a result, the weft, which is ejected from the main air jet nozzle 49 after the occurrence of the picking fault, is guided by the guide plate 63 to the suction nozzle 61, by which the weft is sucked.

Furthermore, the cutting function of the weft cutter (not shown) is temporarily deactuated so that the weft which has been faultily picked is permitted to extend from the main air jet nozzle 49. Accordingly, the weft picking is prevented after the faulty picking signal is emitted. Therefore, the weft extends from the open shed to the main air jet nozzle 49 through the suction nozzle 61.

Figure 2:
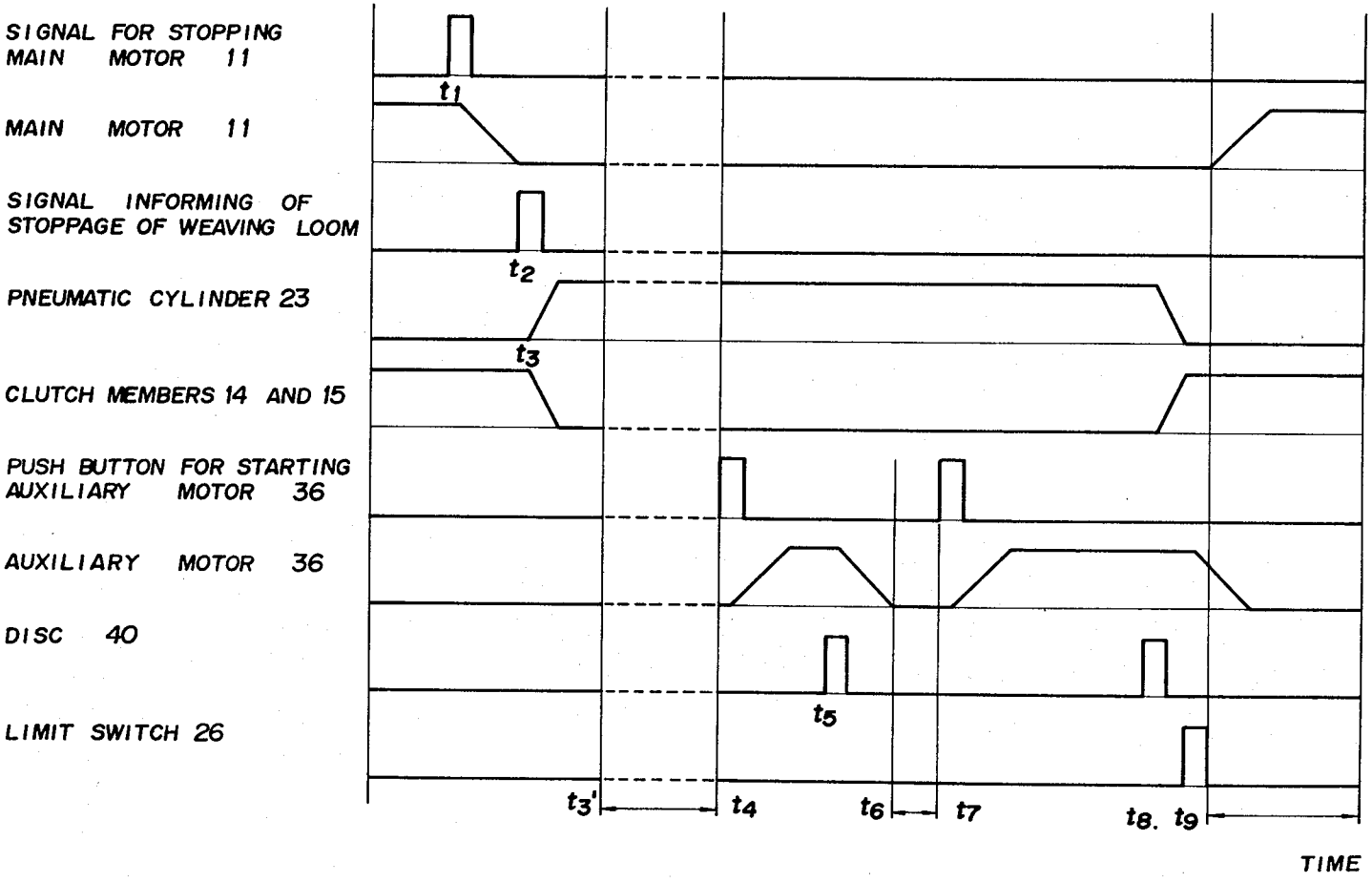
FIG. 2 is an operational diagram of the method of the present invention which will be explained with reference to FIG. 1.

The weaving loom which has been operating due to inertia force stops when the warps 21 are substantially in an open shed condition (i.e., at a crank angle of about 300 degrees) after it has operated about one cycle, and a signal informing of the stoppage of the weaving loom is emitted (at time $t_2$ in FIG. 2).

After the weaving loom stops, the pneumatic cylinder 23 extends (at time $t_3$ in FIG. 2) to disengage the clutch member 15 from the clutch member 14 and engage the gear 34 with the gear 35. As a result, a condition occurs wherein the driven shaft 20 is ready to be driven by the auxiliary motor 36 through the gears 34 and 35.

Under this condition, the operator checks the weaving loom and removes the causes of stoppage. Then, the operation of the weaving loom is restarted. The operator's operations will now be explained in detail.

The operator first checks whether or not the weft extends from the weft cheese 32 to the suction nozzle 61 (at time between $t_3'$ and $t_4$ in FIG. 2).

If the weft correctly extends between the open shed and the main air jet nozzle 49, the operator turns on a push button (not shown) to return the pneumatic cylinder 23 so as to engage the clutch members 14 and 15 with each other. Thereafter, the operation of the weaving loom is restarted.

One of the causes of faulty picking is that the weft is broken anywhere between the weft cheese 32 and the main air jet nozzle 49 and is not fed to the main air jet nozzle 49. In this case, weft does not extend from the weft cheese 32 to the suction nozzle 61. If it is the case, a not illustrated push button is turned on first (at time $t_4$ in FIG. 2) to start the auxiliary motor 36. The auxiliary motor 36 rotates the weft measuring drum 28, and it stops (at time $t_6$) after the disc 40 and the light emitter and receiver 37 and 38 detect that the auxiliary motor 36 has reached a predetermined position (at time $t_6$ in FIG. 2).

The operator withdraws a length of weft from the weft cheese 32 and winds it around the surface of the weft measuring drum 28 by about one turn (between times $t_6$ and $t_7$ in FIG. 2). Then he engages it with the pin 30, and thereafter, the weft is sucked by the suction nozzle 61. The weft may be engaged with a temple (not shown) of the weaving loom and not be sucked by the suction nozzle 61.

When the auxiliary motor 36 is restarted due to the pushing operation of the push button (at time $t_7$ in FIG. 2), the weft measuring drum 28 is rotated by the auxiliary motor 36 through the gears 35 and 34. When the slit or opening of the disc 40 is detected by the light emitter and receiver 37 and 38 (at time $t_9$ in FIG. 2), air is exhausted from the pneumatic cylinder 23. As a result, the gear 34 as well as the clutch member 15 are urged towards the clutch member 14 by the spring 18. However, usually speaking, at this time, the angular phases of the clutch members 14 and 15 are not yet aligned with each other, and in addition, the gears 34 and 35 are engaging each other. Accordingly, the driven shaft 20 is still rotated by the auxiliary motor 36.

It should be noted that until the above-mentioned time $t_9$, the weft has been wound onto the surface of the weft measuring drum 28 for about three turns and a half.

When the phases of the clutch members 14 and 15 are aligned with each other, the clutch members 14 and 15 will engage with each other due to the spring force of the compression spring 18, and at the same time the gear 34 disengages from the gear 35. Accordingly, the rotation of the auxiliary motor 36 is not transmitted to the driven shaft 20. The movement of the clutch member 14 is detected by the limit switch 26 (at time $t_9$ in FIG. 2), the auxiliary motor 36 is stopped, and the main motor 11 is started. Thus, the operation of the weaving loom is restarted, and the weft measuring drum 28 is driven by the main motor 11 through the clutch members 14 and 15.

In the above-described embodiment, the disc 40 is attached to the driven shaft 20 and has a slit or opening formed therein. The slit or opening is detected by means of a paired light emitter and receiver 37 and 38 to detect the angular phase of the driven shaft 20. However, according to this method, there may be a problem that the operation of the light emitter and receiver 37 and 38 is adversely affected to fly, which is inherent to a textile machine including a weaving loom. Further, there may also be a problem that the construction of the device may be complicated and that the cost of the device may be expensive because this method needs a specially designed amplifier.

As described above, a proximity switch may be used in place of the light emitter and receiver 37 and 38. In this case, a dog is attached to a rotary member, i.e., the clutch member 15 or the driven shaft 20 for actuating the proximity switch. This method is preferred because the mechanical life of the switch having no contact disposed therein is long enough, and because the operation of the switch is not adversely affected by fly. However, there may remain problems that the construction of the device is complicated and that the cost of the device is expensive because this method also needs a specially designed amplifier.

To minimize the equipment cost of such detecting device, it has been known to use a dog and a limit switch. In another method, it has also been known to use a dog made of a magnet and a reed switch. However, in these cases, there may be a problem that the mechanical life of the limit switch or the reed switch is insufficient because the limit switch or the mechanical contact of the reed switch is always hit by the dog while the weaving loom is operated. This problem is serious in a weaving loom, especially a jet loom, which is operated at a high speed.

Furthermore, there may remain a problem that the limit switch or reed switch is adversely affected by fly which is inherent to a textile machine.

Some embodiments of the detectors will now be explained. The embodiments are applied to the present invention and can obviate the above-described problems inherent to the conventional devices. More specifically, the detectors are relatively simple in construction and are not expensive in their equipment cost, and have a long mechanical life.

Figure 3:
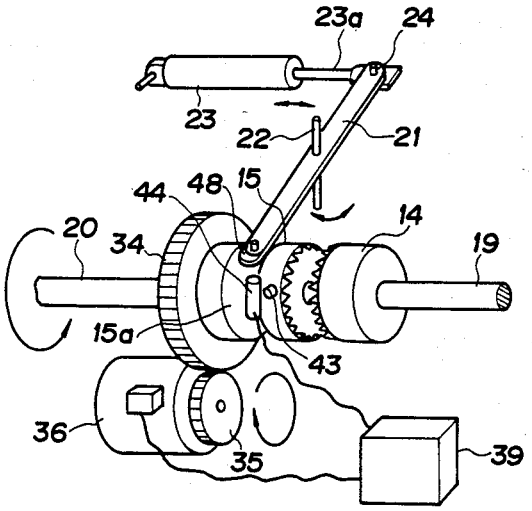
FIG. 3 illustrates a perspective view of the second embodiment of the present invention.

FIG. 3 illustrates another embodiment for detecting and controlling the rotation of an auxiliary motor 36 of a weaving loom in place of the light emitter and receiver 37 and 38 and the disc 40. Similar to the embodiment illustrated in FIG. 1, a pair of mechanical clutch members 14 and 15 are capable of engagement with each other and disengagement from each other, and they are disposed between a driving shaft 19 and a driven shaft 20. More specifically, the clutch member 14 is integrally fixed to the driving shaft 19. The clutch member 15 is splined and engages with the splined driven shaft 20. The clutch member 15 has a gear 34 integrally formed therewith.

A circumferentially extending groove 15*a* is formed between the clutch member 15 and the gear 34. A cam 48 is rotatably mounted on one end of a clutch shift lever 21 and engages the groove 15*a*. The clutch shift lever 21 is swingable about a support pin 22, and the rear end of the lever 21 is connected to a piston rod 23*a* of a pneumatic cylinder 23.

Figure 5:
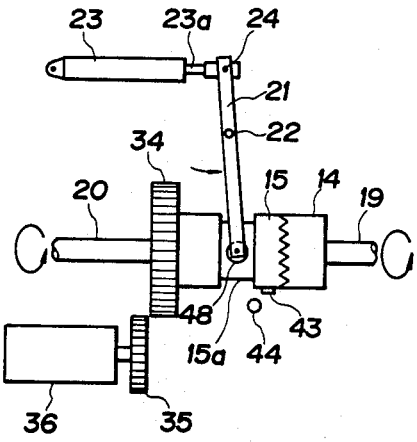

During the normal operation, compressed air is exhausted from the pneumatic cylinder 23 to retract the latter, and the clutch members 14 and 15 are engaged with each other as illustrated in FIG. 5. Thus the rotation of the main motor (not shown) is transmitted to the driven shaft 20 from the driving shaft 19 through the clutch members 14 and 15.

Figure 4:
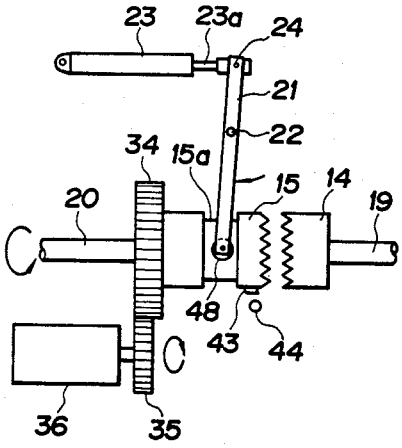
FIGS. 4 and 5 are elevation views of the embodiment illustrated in FIG. 3.

Contrary to this, during abnormal operation, since the pneumatic cylinder 23 is supplied with compressed air and is extended, as illustrated in FIG. 4, the clutch member 14 is released from the clutch member 15, and the gear 34 engages with a gear 35 which is secured to the drive shaft of an auxiliary motor 36. As a result, the driven shaft 20 is driven by the auxiliary motor 36 through the gears 34 and 35.

A magnet 43 projects from the surface of the clutch member 15 to control the rotation of the auxiliary motor 36. A reed switch 44 is in stationary position fixed on the machine frame (not shown), and a reed relay (not shown) of the reed switch 44 is actuated by the magnet 43. Signal emitted from the reed switch 44 is input into a control box 39.

In this embodiment, the position where the reed switch 44 is disposed is so selected that, only during the normal operation illustrated in FIG. 5, the magnet 43 does not make the reed switch 44 operate and that, during the abnormal operation illustrated in FIG. 4, the magnet 43 surely actuates the reed switch 44 by means of the magnetic force of the magnet 43. As a result, the life of the mechanical contact in the reed switch 44 is tremendously increased, because the reed switch 44 is actuated by means of the magnet 43 only during the normal operation.

Since the remaining construction is almost the same as that illustrated in FIG. 1, the remaining construction is not illustrated in FIGS. 3 through 5.

Figure 6:
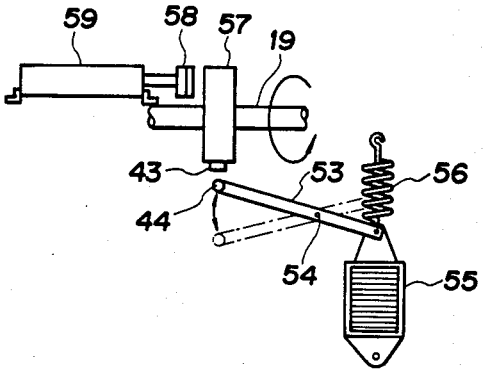
FIG. 6 is an elevation view of the third embodiment of the present invention.

The third embodiment of the detector is illustrated in FIG. 6. In this embodiment, a brake 58 is actuated by a pneumatic cylinder 59 to stop a rotary member 57, such as the clutch member 15, at a predetermined angular position. A magnet 43 projects from the surface of the rotary member 57, and the magnet 43 actuates a reed relay (not shown) of a reed switch 44.

In the embodiment illustrated in FIG. 6, the reed switch 44 is fixed on a lever 53 which is swingable about a pin 54. The lever 53 is usually urged apart from the rotary member 57 in a direction perpendicular to the latter by means of a spring 56. When an electromagnet 55 is energized, the reed switch 44 is moved to a position near the rotary member 57. Accordingly, the reed switch 44 is actuated by the magnet 43 projecting from the surface of the rotary member 57.

In this embodiment, during the normal operation, the electromagnet 55 is deenergized so that the reed switch 44 is apart from the rotary member 57 and is brought into a condition wherein the reed switch 44 does not operate.

When the rotary member 57 is required to be stopped, the electromagnet 55 is energized so that the reed switch 44 nears the rotary member 57. The reed switch 44 detects the magnet 43 disposed on the surface of the rotary member 57 and actuates the brake 58 by means of the pneumatic cylinder 59. Accordingly, the rotary member 57 can be stopped at a predetermined angular position.

As a result, the life of the mechanical contacts in the reed switch 44 is highly increased, since the reed switch 44 is actuated by the magnet 43 only upon the stoppage.

Figure 7:
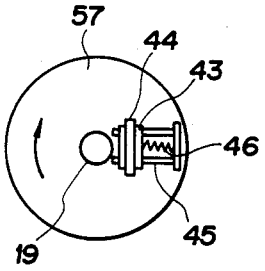
FIGS. 7 and 8 are elevation views of the fourth embodiment of the present invention.
Figure 8:
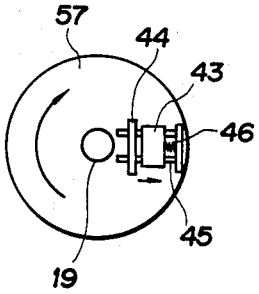

Another embodiment of the detector of the present invention is illustrated in FIGS. 7 and 8. In the embodiment explained with reference to FIG. 6, the reed switch 44 is movably disposed. Contrary to this, in this embodiment, the reed switch 44 is stationary and disposed at a predetermined position on the machine frame (not shown) near the rotary member 57, which is, for example, the clutch member 15 illustrated in FIG. 1 or 3. Further, the magnet 43 is movably mounted on the rotary member 57.

More specifically, the magnet 43 is movable in a radial direction of the rotary member 57 along guide 45, and the magnet 43 is normally urged toward the rotational center of the rotary member 57 by means of a spring 46.

When the rotary member 57 rotates at a low speed, the magnet 43 is located at a position near the rotational center of the rotary member 57 due to the spring force of the spring 46 because the centrifugal force exerting on the magnet 43 is small.

Contrary to this, when the rotary member 57 rotates at a high speed, the magnet 43 moves to the outside from the center of the rotary member 57 against the spring force of the spring 46 due to the centrifugal force.

In accordance with the operational characteristics required of the reed switch 44, the reed switch 44 is disposed at an appropriate position. According to the present invention, the reed switch 44 is required to be actuated by the magnet 43 only during the low rotational speed of the rotary member 57, i.e., the clutch member 15, the reed switch 44 is fixed on the machine frame at a position near the rotational center of the rotary member 57 so that the magnet 43 faces the reed switch 44 during the low speed rotation. Accordingly, during the high speed rotation of the rotary member 57, i.e., the clutch member 15, the magnet moves apart from the reed switch 44, and the life of the contacts in the reed switch 44 can be prolonged.

The embodiments of the present invention explained with reference to FIGS. 3 through 8 are desirable as detectors for detecting and positioning the clutch member 15 at a predetermined angular position during the operation for preparing the weft supply.

We claim:

1. A method for preparing a weft to be picked upon starting the operation of a weaving loom, said weaving loom comprising a means for driving said weaving loom, a means for measuring said weft to be picked by a picking means, a means for driving said weft measuring means, and an auxiliary means for driving said weft measuring means, said method comprising:

releasing a connection between said means for driving said weft measuring means and said weaving loom driving means so as to enable said auxiliary means to drive said means for driving said weft measuring means;

positioning said weft measuring means by means of said auxiliary means at a position suitable for being threaded with said weft;

threading said weft onto said weft measuring means; and driving said weft measuring means by said auxiliary means so as to store a predetermined amount of weft thereon.

2. A method for preparing a weft according to claim 1, wherein said weaving loom driving means includes a crank shaft, said auxiliary driving means includes an auxiliary motor, and said weft measuring means includes a rotary weft measuring drum for measuring and storing said weft, which drum can be selectively connected to said crank shaft and said auxiliary motor through said driving means of said weft measuring means.

3. A method for preparing a weft according to claim 2, wherein said positioning and driving of said weft measuring means to a suitable position is controlled by a detector for detecting rotation of said rotary drum, which detector is disposed between said auxiliary motor and said rotary drum.

4. A method for preparing a weft according to claim 2, wherein clutch members are disposed between said driving means for said rotary drum and said crank shaft of said weaving loom, and engaging portions of said clutch members are eccentric with respect to rotary axes of said clutch members so that said driving means for said rotary drum and said crank shaft of said weaving loom engage with each other only at a predetermined angular phase.

5. An apparatus for preparing a weft to be picked upon starting the operation of a weaving loom, said weaving loom comprising a means for driving said weaving loom, a means for measuring said weft to be picked by said picking means, a means for driving said weft measuring means, shiftable connection means normally engaging said weaving loom driving means and said means for driving said weft measuring means, and an auxiliary means for driving said weft measuring means, said apparatus further comprising:

a means for shifting said connection means from said weaving loom driving means to said auxiliary driving means whereby said auxiliary driving means drives said weft measuring means; and a means for positioning said weft measuring means at a position suitable for being threaded with said weft when said weft measuring means is driven by said auxiliary driving means, and for controlling said auxiliary driving means so as to store a predetermined amount of weft on said weft measuring means after threading said weft thereonto.

6. An apparatus for preparing a weft according to claim 5, wherein said weaving loom driving means includes a crank shaft, said auxiliary driving means includes an auxiliary motor, and said weft measuring means includes a rotary weft measuring drum for measuring and storing said weft, and said positioning and controlling means selectively connects said rotary drum to said crank shaft and said auxiliary motor.

7. An apparatus for preparing a weft according to claim 6, wherein said positioning and driving means includes a detector for detecting rotation of said rotary drum, which detector is disposed between said auxiliary motor and said rotary drum.

8. An apparatus for preparing a weft according to claim 6, wherein said switching means includes clutch members disposed between said driving means for said rotary weft measuring drum and said crank shaft of said weaving loom.

9. An apparatus for preparing a weft according to claim 6, wherein said positioning and driving means includes a detector for detecting rotation of said rotary weft measuring drum, which detector is disposed between said auxiliary motor and said rotary weft measuring drum, and said switching means includes clutch members disposed between said driving means for said weft measuring drum and said crank shaft of said weaving loom.

10. An apparatus for preparing a weft according to claim 8, wherein said clutch members have engaging portions eccentric with respect to the rotary axes thereof so that said driving means of said rotary drum and said crank shaft of said weaving loom engage with each other only at a predetermined angular phase.

11. An apparatus for preparing a weft according to claim 7, wherein said detector comprises a switch member having a mechanical contact and an actuator member for actuating the switch member, the relative locational relationships between the switch member and the actuator member being capable of being changed so that said detector can be selectively in a condition wherein said detector is operable and in a condition wherein said detector is inoperable.

12. An apparatus for preparing a weft according to claim 11, wherein said switch member is a reed relay which is operated by magnetic force, and said actuator member is a magnet which magnetically actuates said reed relay.

13. An apparatus for preparing a weft according to claim 11, wherein said magnet is fixed on one of said clutch members, and said reed relay is movable relative to said magnet.

14. An apparatus for preparing a weft according to claim 11, wherein said switch member is a reed relay which is operated by magnetic force, and said actuator member is a magnet which magnetically actuates said reed relay, said magnet is fixed on one of said clutch members, and said reed relay is fixed at a predetermined position to face said clutch member, whereby said detector can be selectively in said condition wherein said detector is operable and in said condition wherein said detector is inoperable in accordance with said engagement and disengagement of said clutch member.

15. An apparatus for preparing a weft according to claim 14, wherein said magnet is movable in accordance with centrifugal force created by rotation of said clutch member, and said reed relay is fixed at a predetermined position to face said rotary member, whereby said switch can be selectively in said condition wherein said switch is operable and in said condition wherein said switch is inoperable in accordance with said movement of said magnet due to said rotation of said clutch member.

16. An apparatus for preparing a weft according to claim 9, wherein said clutch members have engaging portions eccentric with respect to said rotary axes thereof so that said driving means for said rotary drum and said crank shaft of said weaving loom engage with each other only at a predetermined angular phase.

17. An apparatus for preparing a weft according to claim 9, wherein said detector comprises a switch member having a mechanical contact and an actuator member for actuating the switch member, the relative locational relationships between the switch member and the actuator member being capable of being changed so that said detector can be selectively in a condition wherein said detector is operable and in a condition wherein said detector is inoperable.

18. An apparatus for preparing a weft according to claim 17, wherein said switch member is a reed relay which is operated by magnetic force, and said actuator member is a magnet which magnetically actuates said reed relay.

19. An apparatus for preparing a weft according to claim 17, wherein said magnet is fixed on one of clutch members, and said reed relay is movable relative to said magnet.

20. An apparatus for preparing a weft according to claim 17, wherein said switch member is a reed relay which is operated by magnetic force, and said actuator member is a magnet which magnetically actuates said reed relay, said magnet is fixed on one of said clutch members, and said reed relay is fixed at a predetermined position to face said clutch member, whereby said detector can be selectively in said condition wherein said detector is operable and in said condition wherein said detector is inoperable in accordance with said engagement and disengagement of said clutch member.

21. An apparatus for preparing a weft according to claim 20, wherein said magnet is movable in accordance with centrifugal force created by rotation of said clutch member, and said reed relay is fixed at a predetermined position to face said rotary member, whereby said switch can be selectively in said condition wherein said switch is operable and in said condition wherein said switch is inoperable in accordance with said movement of said magnet due to said rotation of said clutch member.

* * * * *